US007575368B2

(12) United States Patent
Guillaume

(10) Patent No.: US 7,575,368 B2
(45) Date of Patent: Aug. 18, 2009

(54) DEVICE FOR FIXING AN INTERCHANGEABLE WRIST-WATCH STRAP TO A WATCH

(75) Inventor: Hervé Guillaume, Saint Martin Bellevue (FR)

(73) Assignee: Raymond Weil S.A., Grand-Lancy (CH)

( * ) Notice: Subject to any disclaimer, the term of this patent is extended or adjusted under 35 U.S.C. 154(b) by 0 days.

(21) Appl. No.: 11/795,541

(22) PCT Filed: Feb. 8, 2006

(86) PCT No.: PCT/IB2006/000237

§ 371 (c)(1),
(2), (4) Date: Jul. 18, 2007

(87) PCT Pub. No.: WO2006/087615

PCT Pub. Date: Aug. 24, 2006

(65) Prior Publication Data

US 2008/0106980 A1 May 8, 2008

(30) Foreign Application Priority Data

Feb. 18, 2005 (EP) ..... 05003501

(51) Int. Cl.
*G04B 37/00* (2006.01)

(52) U.S. Cl. ..... 368/282; 24/71 J

(58) Field of Classification Search ..... 368/282; 24/265 WS, 265 B, 68 J, 71 J, 69 J
See application file for complete search history.

(56) References Cited

U.S. PATENT DOCUMENTS

| | | | | |
|---|---|---|---|---|
| 4,427,303 | A * | 1/1984 | Matthias | 368/282 |
| 4,605,312 | A * | 8/1986 | Sellier | 368/282 |
| 5,197,046 | A * | 3/1993 | Siu | 368/282 |
| 5,647,518 | A | 7/1997 | Baumgartner et al. | |
| 5,850,675 | A | 12/1998 | Bourquin et al. | |
| 5,914,913 | A * | 6/1999 | Shriqui | 368/282 |
| 6,408,490 | B1 * | 6/2002 | Pequignet | 24/265 WS |
| 7,269,882 | B2 * | 9/2007 | Kato | 24/265 WS |

FOREIGN PATENT DOCUMENTS

| | | |
|---|---|---|
| CH | 343 944 | 11/1959 |
| CH | 662 033 | 9/1987 |
| CH | 685 464 | 7/1995 |
| DE | 91 16 677.2 U | 10/1993 |
| FR | 2 732 786 | 10/1996 |
| FR | 2 738 123 | 3/1997 |
| WO | WO 00/57250 | 9/2000 |

* cited by examiner

*Primary Examiner*—Renee S Luebke
*Assistant Examiner*—Thanh S Phan
(74) *Attorney, Agent, or Firm*—Frommer Lawrence & Haug LLP; Ronald R. Santucci

(57) ABSTRACT

The invention relates to a device for fixing a wrist-watch strap to a watch, comprising a gate connected to the watch by a link and defining a seat for the wrist band, characterized in that it comprises a latch mounted so that it can rotate around a pin and a control device that makes it possible to actuate the latch for moving it from the stable closed position, in which it holds the gate closed, and toward the open position, in which the gate is released and allows access to the seat.

9 Claims, 3 Drawing Sheets

DEVICE FOR FIXING AN INTERCHANGEABLE WRIST-WATCH STRAP TO A WATCH

This application is a 371 of PCT/IB2006/000237 filed on Feb. 8, 2006, published on Aug. 24, 2006 under publication number WO 2006/087615 A1 which claims priority benefits from European Patent Application Number 05003501.3 filed Feb. 18, 2005, the disclosure of which is incorporated herein by reference.

The invention relates to a device for fixing a wrist-watch strap to a watch and also to the corresponding watch and wrist band, and is particularly suited to the user-friendly, rapid changeover of the wrist band. More generally, the device of the invention relates to any object of value of the watch, jewel, compass or other type, that requires reliable, comfortable and esthetically pleasing fixing by means of a wrist band, necklace or any other means. In the following text, for reasons of clarity, this will be called a "wrist band".

Document CH 662 033 describes a first solution for linking a wrist band to a watch, relying on a clasp positioned on either side of the watch and on a wrist band, each of whose two parts has a loop on one end. This loop is inserted in the clasp of the watch. The advantage of this solution is its simplicity and its speed in use. A first drawback is that it requires the addition of these two fixing clasps on the watch, which significantly changes the esthetic appearance of the watch and cannot be incorporated on every type of watch. A second drawback of this solution arises from the fact that the wrist band is not totally fixed to the watch. This solution does not guarantee that the watch will not accidentally become detached from the wrist band.

Document FR 2 732 786 describes another solution for fixing a wrist band to a watch, relying on a wrist band that has a loop at its end designed to be traversed by a rod accommodated in a seat provided at the end of the watch. This solution and also many prior-art variant embodiments have the drawback of requiring a rod between the wrist band and the watch, resulting in a risk that this rod will be lost during fitting and removal of the wrist band. Furthermore, in the solution described in this patent, the rod is simply slipped into a seat and risks being accidentally released. In order to palliate this drawback, other variant embodiments rely on similar, threaded rods that are fixed to the watch by screwing. However, they have the drawback of being complex, as they require a tool, and no longer allow easy, user-friendly changeover of the wrist band.

Document WO 0057250, lastly, describes a third prior-art solution that describes a watch with interchangeable components that allows the combination of a case, a bezel and a wrist band with the aid of an intermediate component. This component is not uniquely dedicated to the fixing of the wrist band to the watch. It is of significant size over the circumference of the watch and is not appropriate for all watches or all types of design. Furthermore, the means for closing the assembly is complex and unreliable, since it requires components to be slid into grooves, which presents a risk of jamming after wear has occurred.

There is therefore a need for another solution for fixing a wrist band to a watch that does not have the above-mentioned drawbacks.

Consequently, a first object of the present invention consists in a reliable, user-friendly device for fixing a wrist band to a watch, allowing wrist bands to be interchangeable thanks to its simplicity of operation.

A second object of the present invention consists in a device for fixing a wrist band to a watch that is compact, esthetically pleasing and compatible with all types of watch.

A third object of the present invention consists in a device for fixing a wrist band to a watch that is inexpensive.

According to the concept of the invention, the fixing device relies on a gate comprising a seat for a wrist band, this gate being actuated simply by a discrete control device that is easy to implement and by an intermediate latch that is able to occupy a stable, "closed" position corresponding to the closed position of the gate.

The invention is defined more precisely by the claims.

These objects, characteristics and advantages of the present invention will be set forth in detail in the following description of a particular, non-limiting embodiment, with reference to the appended figures, in which:

FIG. 1 shows a perspective view of a watch and its wrist band according to one embodiment of the present invention;

FIG. 2*a* shows a sectional view of the preceding watch and wrist band;

FIG. 2*b* shows an enlarged view of the preceding section at the location of the fixing between the wrist band and the watch;

FIGS. 3*a* and 3*b* show a watch in perspective in plan and bottom view of the watch, according to one embodiment of the present invention;

Figure 1:
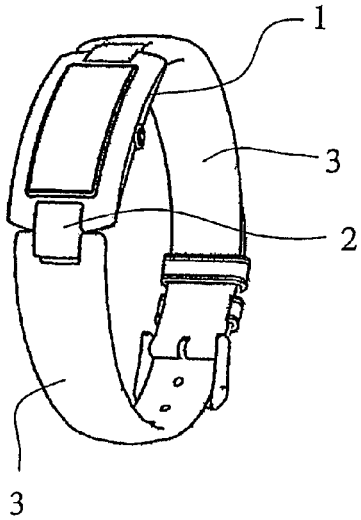
Figure 2A:
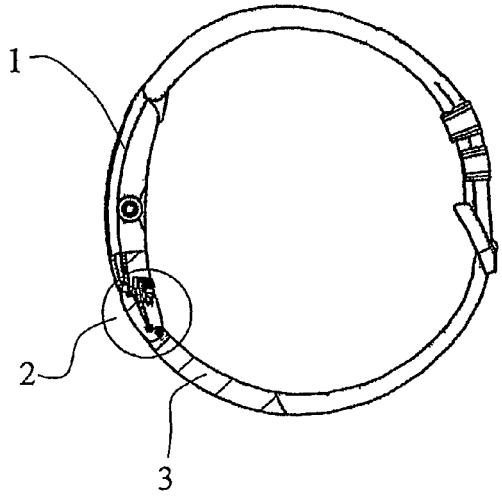

According to one embodiment of the invention, a watch 1 is connected to a wrist band 3 by a fixing device 2. The latter rests on a gate 4 articulated about a pin 5, defining a seat 6 in which is placed a rod 7 arranged in a fixed manner at the end of the wrist band 3. This gate 4 is in contact with a latch 8 of substantially triangular shape, with rounded angles, one angle of which has a part in the form of a hook 9 interacting with a slot 10 of the gate 4 and prevents its rotation and its opening. The latch 8 comprises another, rounded upper angle 11 in contact with a part 12 of the watch on which the gate 4 is mounted in rotation about the pin 5, which serves as axis of rotation of the latch. Finally, the latch comprises a third, rounded rear angle 13 in contact with a control device 14 of the latch. The detailed operation of this mechanism will be described below.

Figure 3A:
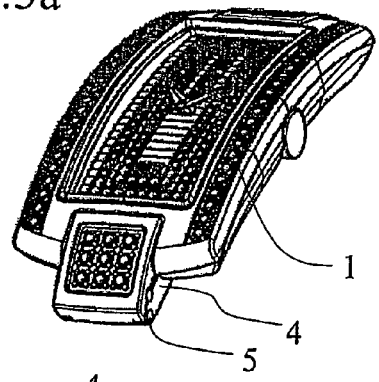
Figure 2B:
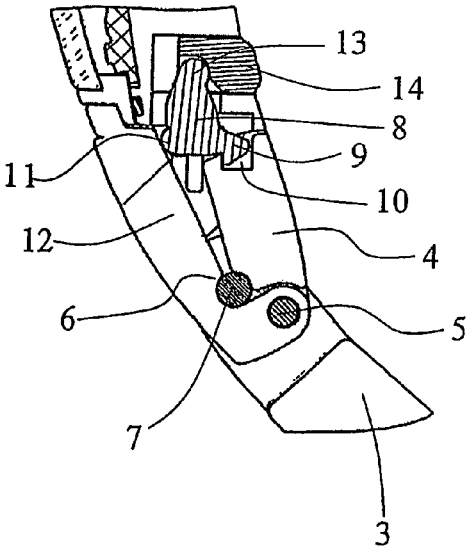
Figure 3B:
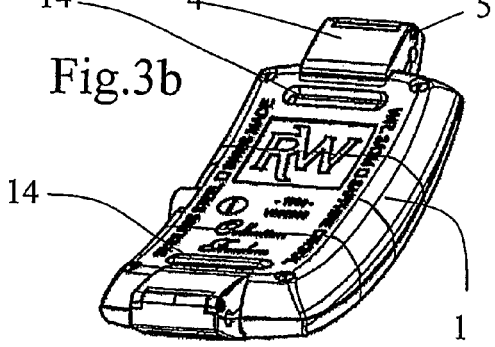

As illustrated in FIGS. 3*a* and 3*b*, this fixing device is arranged at the ends of the watch 1, the gate 4 extending slightly in the longitudinal direction corresponding to the larger sides of the rectangular frame of the watch. It is placed on the lower face of the watch, as is its control device, which has the form of a button that is elongate in a transverse direction. An arrangement of this type enhances the esthetic appearance of the upper face of the watch and makes it possible to place the mechanism components discretely on the lower face. It also makes it possible to prevent unintentional actuation of this mechanism.

Figure 4:
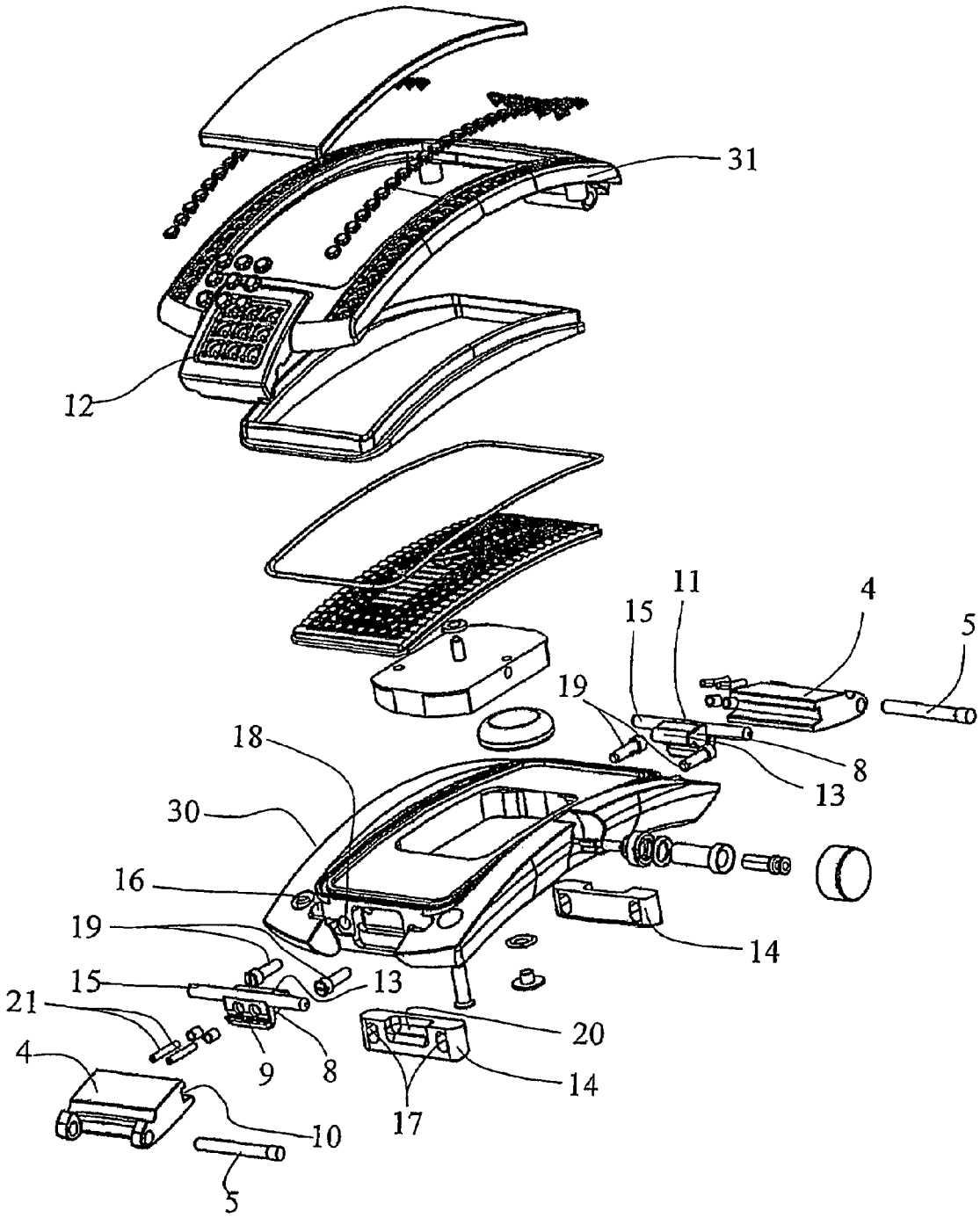
FIG. 4 shows an expanded, perspective view of the watch according to one embodiment of the present invention.

As is more particularly illustrated in FIG. 4, the watch 1 comprises a conventional stacked arrangement of a dial, of glasses and joints, of a bezel on a base 30.

The upper middle 31 comprises a support extension 12 on each side, designed for mounting of the gate 4 on a rotation pin 5 of the device for fixing the wrist band and the base 30 comprises lateral seats in which the other components of this device are superposed.

This superimposition of components thus comprises the following components in the following order:

a control device 14, which comprises two oblong openings 17 extending vertically, allowing its movable linking to the base 30 by means of two screws 19 traversing these openings 17 and accommodated in two threaded parts 18 of the base 30. The control device 14 also comprises a central opening 20 in which the rear protuberant part 13 of the latch 8 is positioned;

a latch 8, which is mounted in rotation about a pin 15, corresponding substantially to its upper rounded angle 11 mentioned above, positioned in a seat 16 of the base 30 of the watch;

two small flexible rods 21 accommodated in two openings at the front of the latch, above the hook part 9 of the latch. This part 9 interacts with the slot or groove 10 of the edge of the gate 4, while the rods 21 interact with the upper surface of the gate 4.

The operation of this device 2 for interchangeable fixing of the wrist band 3 to the watch 1 will now be described with reference to FIGS. 5 and 6.

Figure 5:
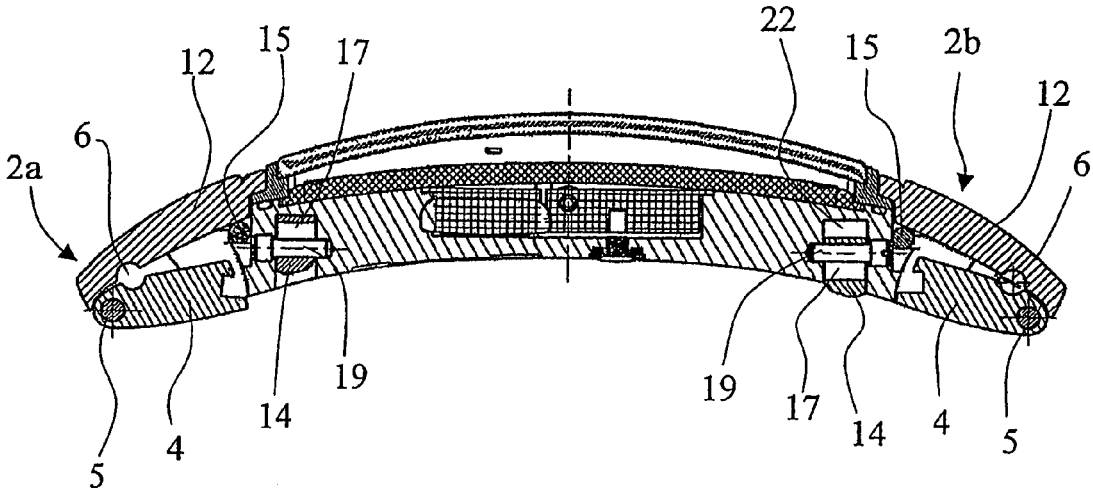
FIG. 5 shows a first sectional view of the watch, according to one embodiment of the present invention.
Figure 6:
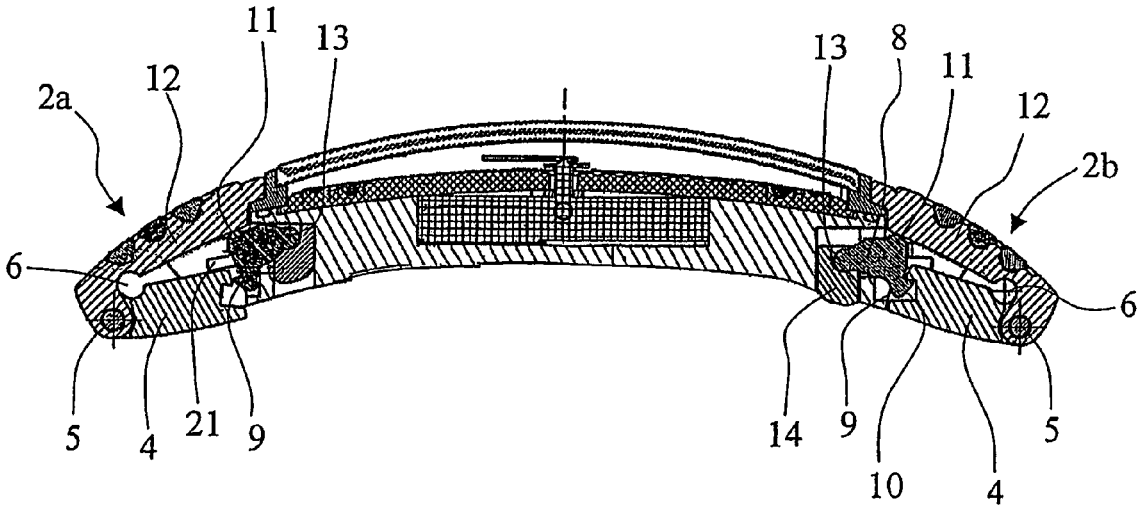
FIG. 6 shows a second sectional view of the watch, according to one embodiment of the present invention.

FIG. 5 shows a longitudinal section of the watch, i.e. in the direction of the wrist band and of the larger side of the rectangular frame, in a plane passing through the watch at the center of the fixing screws 19 of the control device 14 of each lateral fixing device. FIG. 6 shows a longitudinal section in another plane, parallel to the preceding plane, passing through the middle of the latches 8 on each side of the watch. In these two figures, the fixing device 2*a* on the left is in the open position whereas the fixing device 2*b* on the right is illustrated in the closed position.

The substantially triangular latch 8 thus comprises an upper rounded angle 11, which corresponds to the pin 15 for the latch to rotate relative to the watch, a rear lower end 13, which interacts with the control button 14, and a front lower end 9 that interacts with the gate 4.

In the closed position, the upper end of the pin 15 of the latch 8 bears on the support part 12 of the watch, its end 13 is in its lowest position, as is the control device 14 linked to it, and its end 9 is in its highest position, holding the gate 4 by its hook housed in its groove 10 of its edge in its closed position. The control device 14 thus occupies its lowest position, the screw 19 bearing on the upper face of its vertical oblong opening 17. This closed position is a stable position. Indeed, in this position, the moment exerted by the weight of the gate 4 on the latch at the level of the hook 9 is practically zero because it is very close to the rotation pin 15, and the shape of the latch 8, particularly in terms of its upper rounded part 11 and the distribution of its weight, defines a stable, closed position of the latch and requires a degree of force in order to obtain its rotation.

Movement toward the open position is achieved by actuating the control button 14 upward, which gives rise to its displacement by virtue of the vertical extension of its oblong opening 17 and the space 22 provided within the base 30. This upward movement of the control device 14 is possible until such point as the lower face of its oblong opening 17 comes into contact with the screw 19. This displacement transmits a force to the end 13 of the latch 8, which causes it to rotate about its pin 15, giving rise to a downward rotation of the hook 9. The shape of the latch is provided so that the high position of the control device 14 enables the hook 9 of the latch 8 to leave the groove 10 of the gate 4 and to release it. At the same time, the rod 21 bearing on the upper surface of the gate 4 gives rise to its downward rotation and its opening, allowing it to be seized manually in order to continue its opening movement with a view to attaining the seat 6 for removal and/or positioning of the rod 7 of a wrist band.

The gate 4 is closed by manually actuating the gate and by pressing it upward. This pressure causes the gate 4 to bear on the rods 21, which causes the latch 8 to rotate in the closure direction, at the same time generating a downward movement of the control device 14. The shape of the upper rounded part 11 of the latch 8 is such that the force required to close the gate 4 again is relatively low. However, in order to close it completely, the end of the movement of the gate requires a greater force, which gives rise to a sudden rotation of the latch toward its closed, equilibrium position, accompanied by a slight, audible click, which indicates to the user that the gate is indeed closed again.

This device has been illustrated by way of example with the aid of a device based on a gate mounted on an extension 12 of the watch 1. However, a similar device could be incorporated entirely within the volume of the watch, the pin 5 being accommodated toward one end of the watch. Thus, this solution can be adapted to several watch types, round watches, for example, and can be adapted to various sought-after esthetic arrangements.

The control device has been placed on the lower face of the watch, practically not extending beyond this surface, which offers the advantage of rendering it invisible and unobtrusive in terms of the usual esthetic appearance of the watch, while at the same time preventing it from being actuated accidentally. Nevertheless, this concept of the invention could be used with this device being placed on the upper face.

Similarly, the gate could be opened in a direction other than that illustrated by way of example, and the latch could have a different shape for implementing the same function.

Lastly, the fixing device described concerns the fixing of a wrist band to a watch. In the embodiment described, it is arranged entirely on the watch, the wrist band having just a rod for implementing fixing according to the invention. However, as an alternative, all or some of the fixing functions implemented may be placed at the end of the wrist band and not on the watch.

The invention claimed is:

1. A device for fixing a wrist-watch strap to a watch, comprising a gate connected to the watch by a link and defining a seat for the wrist strap, wherein the device comprises a latch mounted so that the latch is movable relative to the gate and can rotate about a pin placed in a seat of a base of the watch, the latch comprising a front end interacting with the gate and a rear end interacting with a control device movable in a space of the base of the watch, the control device making it possible to actuate the latch for moving the latch from a stable, closed position, in which the latch holds the gate closed, toward an open position, in which the gate is released and allows access to the seat for the wrist strap.

2. The device for fixing a wrist-watch strap to a watch as claimed in claim 1, wherein the front end of the latch comprises a hook part interacting with a slot of the edge of the gate and a flexible part interacting with the surface of the gate, the hook part releasing the gate and the flexible part generating its opening upon rotation of the latch toward the open position.

3. The device for fixing a wrist-watch strap to a watch as claimed in claim 1, wherein the control device comprises at least one oblong opening for connecting it to the base of the watch, movably by means of a screw passing through this opening, and a cavity interacting with the rear part of the latch.

4. The device for fixing a wrist-watch strap to a watch as claimed in claim 3, wherein the gate is mounted in rotation on a support element of the watch about a pin placed at a periphery of the watch, and in that the pin of the latch forms a rounded upper part of the latch bearing on a lower face of this support element of the watch.

5. The device for fixing a wrist-watch strap to a watch as claimed in claim 4, wherein an end of the control device is visible and can be actuated in a window of a lower face of the watch.

6. The device for fixing a wrist-watch strap to a watch as claimed in claim 1, wherein the watch has a rectangular shape, and in that a support element forms an extension part of the watch, linked to an upper middle portion of the latch.

7. The device for fixing a wrist-watch strap to a watch as claimed in claim 1, wherein the seat for the wrist strap is capable of containing a rod of the wrist band.

8. A watch comprising a device for fixing a wrist-watch strap as claimed in claim 1.

9. A wrist-watch strap comprising a rod fixed at one end in order to interact with a fixing device as claimed in claim 1.

* * * * *